US009109469B2

(12) United States Patent
Kim et al.

(10) Patent No.: US 9,109,469 B2
(45) Date of Patent: Aug. 18, 2015

(54) APPARATUS FOR ACTUATING VALVES IN VEHICLES IN VARIABLE VALVE CONTROL MANNER

(71) Applicant: Hyundai Motor Company, Seoul (KR)

(72) Inventors: Jung Ho Kim, Yongin-si (KR); Gi Ra Lee, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/046,305

(22) Filed: Oct. 4, 2013

(65) Prior Publication Data

US 2014/0366820 A1 Dec. 18, 2014

(30) Foreign Application Priority Data

Jun. 17, 2013 (KR) ..... 10-2013-0068966

(51) Int. Cl.

| | |
|---|---|
| ***F01L 1/34*** | (2006.01) |
| ***F01L 9/02*** | (2006.01) |
| ***F01L 1/26*** | (2006.01) |
| ***F01L 13/06*** | (2006.01) |
| *F02M 59/10* | (2006.01) |

(52) U.S. Cl.

CPC ..... *F01L 9/021* (2013.01); *F01L 1/267* (2013.01); *F01L 13/065* (2013.01); *F01L 2820/033* (2013.01); *F02M 59/102* (2013.01)

(58) Field of Classification Search

CPC ..... F01L 9/021; F01L 1/267; F02M 9/102

USPC ..... 123/90.12, 90.13, 90.16, 90.44

See application file for complete search history.

(56) References Cited

U.S. PATENT DOCUMENTS

| | | | | |
|---|---|---|---|---|
| 5,537,976 | A * | 7/1996 | Hu | 123/322 |
| 5,890,469 | A | 4/1999 | Hakansson et al. | |
| 6,912,458 | B2 * | 6/2005 | Pierpont et al. | 701/102 |

FOREIGN PATENT DOCUMENTS

| | | | |
|---|---|---|---|
| JP | 3411882 | B2 | 6/2003 |
| JP | 2003-239710 | A | 8/2003 |
| JP | 2007-247628 | A | 9/2007 |
| JP | 2008-223517 | A | 9/2008 |
| KR | 10-2007-0012536 | A | 1/2007 |
| KR | 10-2012-0088816 | A | 8/2012 |
| KR | 10-1272942 | B1 | 6/2013 |
| WO | WO 2011/056821 | A1 | 5/2011 |

* cited by examiner

*Primary Examiner* — Ching Chang

(74) *Attorney, Agent, or Firm* — Morgan, Lewis & Bockius LLP

(57) ABSTRACT

An apparatus for actuating valves in vehicles in a variable valve control manner, may include an eccentric cam mounted on a cylinder head and rotating with power transmitted from a crank shaft, a high-pressure pump connected to an oil pump, wherein one end of the high-pressure pump may be pushed by the eccentric cam when the eccentric cam rotates, converting low-pressure oil supplied from the oil pump into high-pressure oil, a high-pressure rail connected with the high-pressure pump to accommodate the high-pressure oil from the high-pressure pump and store the high-pressure oil therein, and an operating cylinder connected with the high-pressure rail and having a plunger pushing an intake or exhaust valve with a pressure of oil received from the high-pressure rail.

9 Claims, 2 Drawing Sheets

APPARATUS FOR ACTUATING VALVES IN VEHICLES IN VARIABLE VALVE CONTROL MANNER

CROSS REFERENCE TO RELATED APPLICATION

The present application claims priority to Korean Patent Application No. 10-2013-0068966 filed on Jun. 17, 2013, the entire contents of which is incorporated herein for all purposes by this reference.

BACKGROUND OF THE INVENTION

1. Field of the Invention

The present invention relates, in general, to an apparatus for actuating valves in vehicles in a variable valve control manner that hydraulically controls the valves with respect to the timing and lift on opening of the valves.

2. Description of Related Art

Generally, engines have predetermined valve opening/closing timing that is able to produce maximum output at specified revolutions per minute (RPM). That is, engines need a slow valve opening/closing timing at a low RPM in order to perform expansion and explosion of a fuel-air mixture, and engines need a rapid valve opening/closing timing at a high RPM in order to perform exhaust of the exploded fuel-air mixture. However, if the timing is set to the low or high RPM mode at high or low RPM, respectively, the exhaust or compression, respectively, of the fuel-air mixture is delayed, resulting in a considerable reduction in performance of engines.

In order to solve these problems, a variable valve timing technology has been developed, which alters the opening/closing timing of intake or exhaust valves depending upon the RPM of an engine, thereby obtaining high fuel-efficiency and output at both low and high RPMs. The technology has three types of operation: altering only the timing of valve opening/closing; altering both the timing and lift of valve opening/closing; and altering only the lift of valve opening/closing.

However, generally, in order to control the timing and lift of valve opening/closing, high-pressure hydraulic systems should be provided for each cylinder, which thus increases the manufacturing cost and weight of a product. Further, due to a pressure differential occurring between cylinders, there is also a difference in lift of valve opening/closing for each cylinder, and all of the cylinders generate high hydraulic pressure, thereby resulting in an occurrence of power loss owing to the generation of high pressure, and therefore deteriorating fuel efficiency.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an apparatus for actuating valves in vehicles in a variable valve control manner, in which a high-pressure rail is provided at a central site thereof such that the rail is connected to all of a plurality of cylinders, and a plurality of compressors are provided so as to create high pressure through the high-pressure rail, so that all of the cylinders use the same high-pressure so as to reduce power loss occurring due to the creation of the high-pressure.

In an aspect of the present invention, an apparatus for actuating valves in vehicles in a variable valve control manner, may include an eccentric cam mounted on a cylinder head and rotating with power transmitted from a crank shaft, a high-pressure pump connected to an oil pump, wherein one end of the high-pressure pump is pushed by the eccentric cam when the eccentric cam rotates, converting low-pressure oil supplied from the oil pump into high-pressure oil, a high-pressure rail connected with the high-pressure pump to accommodate the high-pressure oil from the high-pressure pump and store the high-pressure oil therein, and an operating cylinder connected with the high-pressure rail and having a plunger pushing an intake or exhaust valve with a pressure of oil received from the high-pressure rail.

A connection link is provided between the high-pressure pump and the eccentric cam, wherein one end of the connection link comes into contact with one end of the high-pressure pump, wherein the other end of the connection link may have a roller coming into contact with the eccentric cam, and wherein a middle member is pivotally coupled with a cam shaft and the other end of the connection link so as to rotate about the cam shaft.

A low-pressure solenoid valve is provided between the high-pressure pump and the oil pump so as to selectively restrict an inflow of oil into the high-pressure pump.

A spring is provided to a cylinder part of the high-pressure pump so as to force the high-pressure pump to be compressed when the low-pressure oil is not introduced into the cylinder part, such that one end of the high-pressure pump does not come into contact with the connection link.

A first check valve is provided between the high-pressure pump and the oil pump so as to prevent the high-pressure oil generated from the high-pressure pump from flowing reversely towards the oil pump.

A second check valve is provided between the high-pressure pump and the high-pressure rail so as to prevent the oil in the high-pressure rail from flowing into the cylinder part.

The high-pressure rail may include a pressure control valve provided above the cam shaft in a longitudinal direction of the cam shaft and configured to discharge the oil contained therein out of the high-pressure rail when an internal pressure of the high-pressure rail reaches a predefined pressure level or more in order to maintain a constant pressure of the oil contained therein.

A high-pressure solenoid valve is provided between the high-pressure rail and the operating cylinder so as to regulate the amount of the oil flowing into the operating cylinder.

One end of the operating cylinder is connected with the high-pressure rail and the plunger comes into contact with an upper side of a rocker arm such that the rocker arm rotates as the pressure of the oil increases while the oil is introduced into the operating cylinder, so as to regulate an amount of lift of the intake or exhaust valve.

The operating cylinder is provided with a drain hole for oil, through which the oil is discharged irrespective of feeding of oil to the operating cylinder.

According to the apparatus for actuating valves in vehicles in a variable valve control manner, only a few elements are provided instead of separate devices for creating high pressure, thereby considerably reducing power for the creation of high pressure and therefore improving fuel efficiency.

Further, the provision of fewer compression elements allows for reduction in the manufacturing cost and weight of a product, compared to the provision of separate compression devices, and the provision of the central high-pressure rail allows for feeding a constant pressure to all of the cylinders, removing a difference in lift of valves for each cylinder.

Furthermore, at normal conditions in which valves are not operated in a variable control manner, the compression elements are not actuated, thereby further improving the fuel efficiency.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
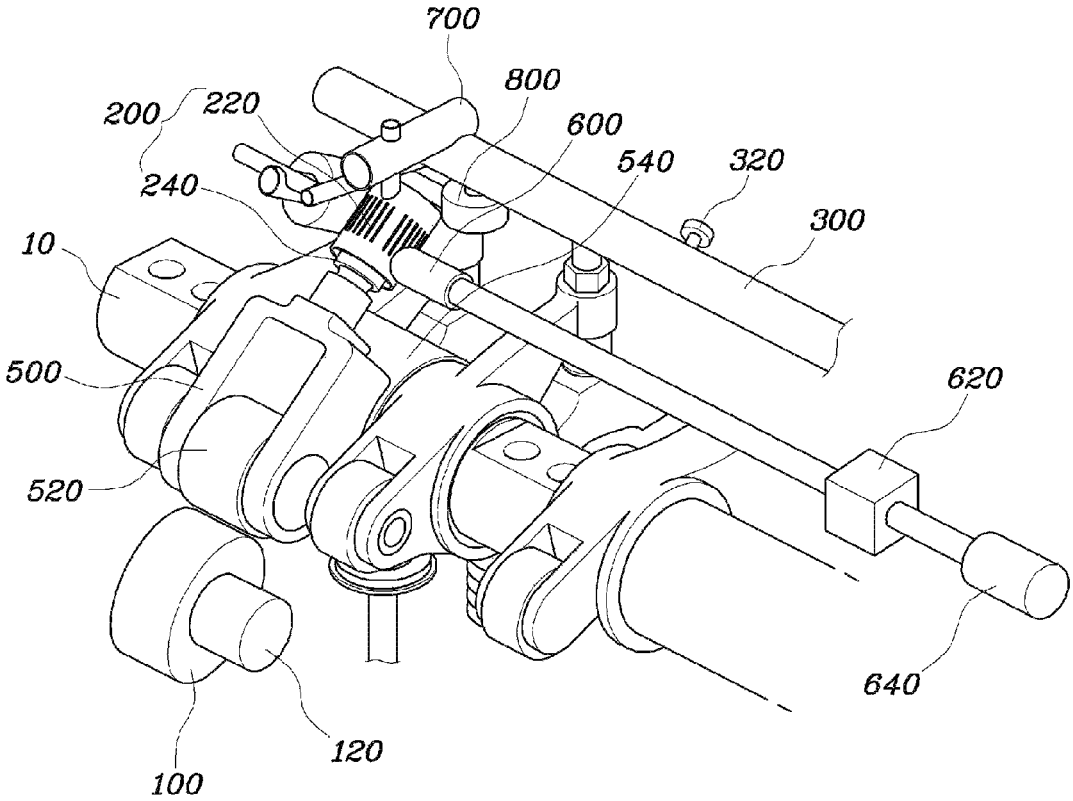
FIG. 1 is a view showing a rear side of an apparatus for actuating valves in vehicles in a variable valve control manner according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Reference will now be made in greater detail to a preferred embodiment of the invention, an example of which is illustrated in the accompanying drawings.

FIG. 1 is a view showing a rear side of an apparatus for actuating valves in vehicles in a variable valve control manner according to an exemplary embodiment of the present invention. The apparatus includes: an eccentric cam 100 which is mounted on a cylinder head and is configured to rotate with power transmitted from a crank shaft, a high-pressure pump 200, one end of which is pushed when the eccentric cam rotates, so as to convert low-pressure oil supplied from an oil pump into high-pressure oil, a high-pressure rail 300 which is connected with the high-pressure pump 200 to accommodate the high-pressure oil from the high-pressure pump and store the high-pressure oil therein, and an operating cylinder 400 which is connected with the high-pressure rail 300 and has a plunger 420 which is configured to push an intake or exhaust valve with the pressure of oil.

Specifically, a cam shaft 120 is provided such that the cam shaft is connected with the crank shaft via a chain or a gear so that the cam shaft rotates together with or separately from a cam shaft 10. The eccentric cam 100 rotates while being connected to the cam shaft 120. Although the eccentric cam 100 has an oval shape as shown in FIG. 1, the shape may be of other shapes such as a one-sided protrusion.

Further, a connection link 500 is provided between the high-pressure pump 200 and the eccentric cam 100, such that one end thereof comes into contact with one end of the high-pressure pump 200, and the other end thereof has a roller 520 that comes into contact with the eccentric cam 100, and a middle member 540 is coupled with the cam shaft 10 and the other end of the connection link 500 so as to rotate about the cam shaft 10. Thus, whenever the eccentric cam 100 rotates eccentrically, the connection link 500 rotates about the cam shaft 10 while pushing the high-pressure pump 200 to create high-pressure oil.

While the middle member 540 of the connection link 500 is coupled with the cam shaft 10, it is not fixed thereto, so it is preferably rotatable irrespective of the rotation of the cam shaft 10.

Further, since the roller 520 is provided at the end of the connection link in contact with the eccentric cam 100, damage occurring due to friction between the high-pressure pump 200 and the eccentric cam 100 is prevented.

Although the connection link 500 is provided between the eccentric cam 100 and the high-pressure pump 200 so as to prevent direct contact between the eccentric cam 100 and the high-pressure pump 200, it may be omitted so that the eccentric cam 100 and one end of the high-pressure pump 200 can come into contact with each other. In this case, the connection link 500 is not required, so the mounting cost for the connection link 500 and the entire weight of an apparatus can be reduced.

The high-pressure pump 200 is connected with the oil pump and the high-pressure rail 300 so that the high-pressure pump is supplied with low-pressure oil from the oil pump and outputs high-pressure oil to the high-pressure rail 300. The high-pressure pump has channels for the connection with the oil pump and the high-pressure rail 300, respectively, and first and second check valves 600 and 700 are provided on the respective channels so as to prevent the oil from flowing reversely.

Specifically, the first check valve 600 is provided between the high-pressure pump 200 and the oil pump so as to prevent high-pressure oil generated from the high-pressure pump 200 from reversely flowing towards the oil pump. The second check valve 700 is provided between the high-pressure pump 200 and the high-pressure rail 300 so as to prevent the oil contained in the high-pressure rail 300 from being introduced into the cylinder part.

With the provision of check valves, when a piston 240 of the high-pressure pump 200 is pulled down to create vacuum, only the low-pressure oil can be smoothly introduced into the cylinder part 220 of the high-pressure pump 200. Thus, high-pressure oil in the high-pressure rail 300 can stably maintain highly-compressed state without pressure loss. Further, when the piston 240 is pushed up to create high pressure, the high-pressure oil does not flow reversely towards the oil pump, but can be introduced into the high-pressure rail 300 without pressure loss.

Further, a low-pressure solenoid valve 620 is provided between the high-pressure pump 200 and the oil pump 640 so as to restrict an inflow of oil into the high-pressure pump 200. The low-pressure solenoid valve 620 blocks the flow of oil between the high-pressure pump 200 and the oil pump 640 to restrict an inflow of oil into the high-pressure pump 200 when receiving an external signal such as a signal from a controller, such as an ECU, signifying that there is no need to variably actuate valves.

Further, a spring is provided to the cylinder part 220 of the high-pressure pump 200 so as to force the high-pressure pump 200 to be compressed when the low-pressure oil is not introduced into the cylinder part 220, such that one end of the high-pressure pump 200 cannot come into contact with the connection link 500.

Specifically, the high-pressure pump 200 is provided, in the cylinder part 220, with the spring which applies an elastic force to the piston 240 so as to push it up in the cylinder part 220, thereby compressing the high-pressure pump 200. Further, when the low-pressure solenoid valve 620 performs a blocking action so that the low-pressure oil is not introduced into the cylinder part 220 of the high-pressure pump 200 from the oil pump 640, the high-pressure pump 200 maintains its compressed state by the action of the spring. Here, instead of the spring, a variety of elastic members can be used so as to exert an elastic force.

When the high-pressure pump is in the compressed state, the high-pressure pump 200 and the connection link 500 are in a released state. Thus, even though the connection link 500 rotates by the action of the eccentric cam 100, the connection link does not come into contact with the high-pressure pump 200, so the eccentric cam 100 cannot be applied with a load, resulting in no power loss during the operation of the high-pressure pump 200.

If a controller determines that variable actuation of valves is required, the low-pressure solenoid valve 620 opens a channel between the oil pump 640 and the high-pressure pump 200 to allow an inflow of low-pressure oil into the cylinder part 220 of the high-pressure pump 200. Then, the introduced oil forces the piston 240 of the high-pressure pump 200 against the spring force of the spring, enabling the high-pressure pump 200 and the connection link 500 to come into contact again with each other. This enables the high-pressure pump to create high pressure with its pumping action.

Further, the resulting high-pressure oil is introduced into the high-pressure rail 300 through the second check valve 700. The high-pressure rail 300 includes a pressure control valve 320 which is provided above the cam shaft 10 in a longitudinal direction of the cam shaft 100. The pressure control valve is configured to discharge the oil contained therein out of the high-pressure rail 300 when an internal pressure of the high-pressure rail 300 reaches a predefined pressure or more in order to maintain a constant pressure of the oil contained therein.

Since the high-pressure rail 300 should supply high-pressure oil required for variable actuation of valves for each engine cylinder, the high-pressure rail preferably has sufficient oil storage capacity to perform variable actuation of the valves. Further, the high-pressure rail is preferably supplied with high-pressure oil from unitary or plural high-pressure pumps 200.

The pressure control valve 320 discharges the high-pressure oil in the high-pressure rail 300 when the internal pressure of the high-pressure rail reaches a predefined pressure level or more. The discharge oil from the pressure control valve 320 may be introduced into an oil path in an engine through a separate channel, or otherwise may be directly discharged out of the pressure control valve 320 without passing through the separate channel. Even in such a case, there is no problem because engine oil continuously flows through a cylinder head.

With the provision of the high-pressure rail 300, the operating cylinder 400 can be continuously fed with constant pressure of oil, and identical pressure of oil can be stably fed for each engine cylinder.

Figure 2:
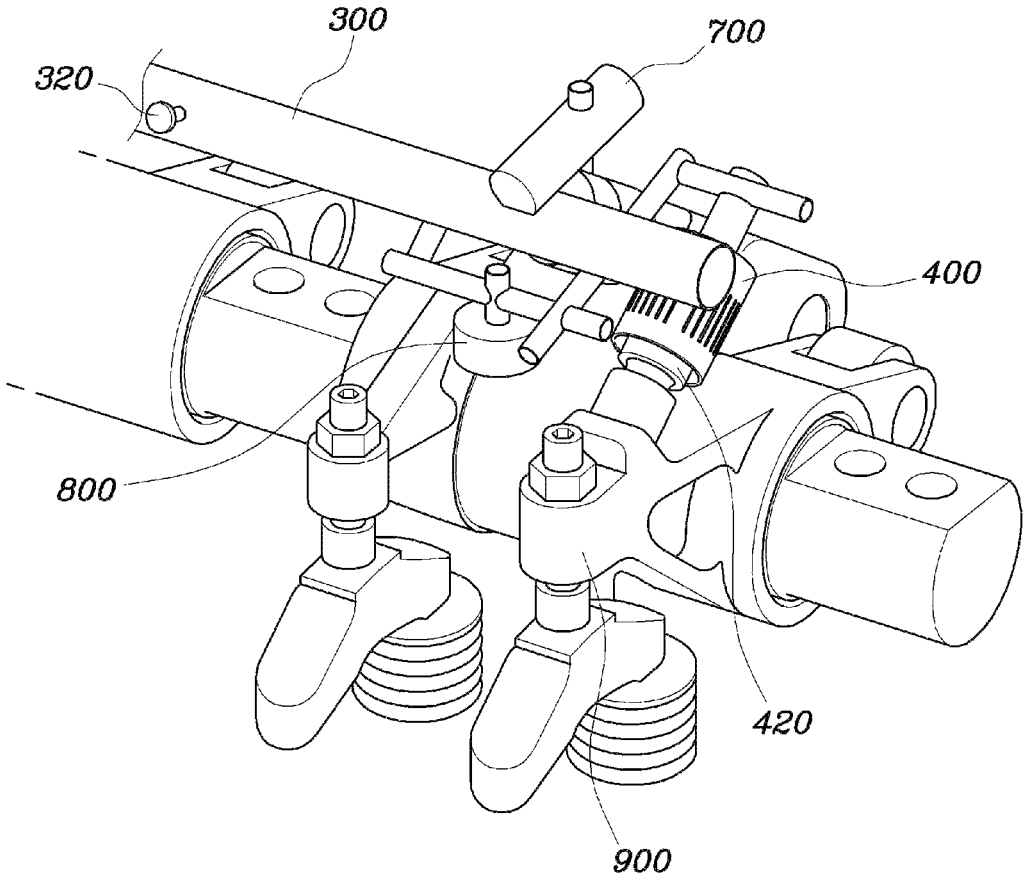
FIG. 2 is a view showing a front side of the apparatus for actuating valves in vehicles in a variable valve control manner according to the exemplary embodiment of the present invention.

In the meantime, FIG. 2 is a view showing a front side of the apparatus for actuating valves in vehicles in a variable valve control manner according to the exemplary embodiment of the present invention. The high-pressure oil stored in the high-pressure rail 300 is transmitted to the operating cylinder 400. A high-pressure solenoid valve 800 is provided between the high-pressure rail 300 and the operating cylinder 400 so as to regulate the amount of the oil flowing into the operating cylinder 400.

With the provision of the high-pressure solenoid valve 800, high-pressure oil with constant pressure can be introduced into the operating cylinder 400 by an appropriate amount, and thus the precise timing and lift of valve opening/closing can be controlled.

If the controller determines that variable actuation of valve is not required, the controller sends a signal to the high-pressure solenoid valve 800 to block a flow between the high-pressure rail 300 and the operating cylinder 400 so as to prevent the oil from being further introduced into the operating cylinder 400.

One end of the operating cylinder 400 is connected with the high-pressure rail 300 and the plunger 420 comes into contact with an upper side of a rocker arm 900 such that the rocker arm 900 rotates as the pressure of the oil increases while the oil is introduced into the operating cylinder, so as to regulate an amount of lift of the intake or exhaust valve. That is, although, when the oil is not introduced, the rocker arm 900 operates along a basic shape of a cam, when the oil is introduced so that the plunger 420 protrudes to push the upper side of the rocker arm 900, the rocker arm 900 rotates so as to lift the valve by an amount of protrusion of the plunger 420.

Further, the operating cylinder 400 is provided with a drain hole for oil, through which the oil is discharged irrespective of feeding of oil to the operating cylinder 400. When the operating cylinder 400 is operated and a supply of the high pressure oil is blocked, the oil in the operating cylinder should be discharged, so the oil can be naturally drained through the drain hole.

Since the drain hole always maintains an open state, the oil is always discharged out through the drain hole. Thus, when the operating cylinder 400 is operated, oil is newly introduced by an amount of the oil being discharged out through the drain hole.

The drain hole may be provided at the operating cylinder 400 or the plunger 420, or otherwise at a gap therebetween, and may be of an arbitrary shape.

With the provision of drain hole allowing instant discharge of the oil, a separate device for performing drainage of oil only when needed is not required, and oil always exists in the cylinder head so there is no oil loss. Further, since the high-pressure rail 300 has sufficient oil storage capacity to perform variable actuation of the valves, even when the operating cylinder 400 is operated and the oil is continuously discharged, the amount of oil being supplied is sufficient. Rather, a separate device is not required, so the effects of reduction in weight and cost are provided.

When the oil in the operating cylinder 400 is discharged, the plunger 420 is inserted again into the operating cylinder 400 by the spring action of a valve spring, and thus no longer restricts the rotation of the rocker arm 900.

According to the apparatus for actuating valves in vehicles in a variable valve control manner, only a few elements are provided instead of separate devices for creating high pressure, thereby considerably reducing power for the creation of high pressure and therefore improving fuel efficiency.

Further, the provision of fewer compression elements allows for reduction in the manufacturing cost and weight of a product, compared to the provision of separate compression devices, and the provision of the central high-pressure rail 300 allows for feeding a constant pressure to all of the cylinders, removing a difference in lift of valves for each cylinder.

Furthermore, at normal conditions in which valves are not operated in a variable control manner, the high-pressure pump 300 is not actuated, thereby further improving the fuel efficiency.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for actuating valves in vehicles in a variable valve control manner, comprising:

an eccentric cam mounted on a cylinder head and rotating with power transmitted from a crank shaft;

a high-pressure pump connected to an oil pump, wherein a first end of the high-pressure pump is pushed by the eccentric cam when the eccentric cam rotates, converting low-pressure oil supplied from the oil pump into high-pressure oil;

a high-pressure rail connected with the high-pressure pump to accommodate the high-pressure oil from the high-pressure pump and store the high-pressure oil therein;

an operating cylinder connected with the high-pressure rail and having a plunger pushing an intake or exhaust valve with a pressure of oil received from the high-pressure rail;

a connection link provided between the high-pressure pump and the eccentric cam, wherein a first end of the connection link is engaged with the first end of the high-pressure pump, and wherein a second end of the connection link has a roller coming into contact with the eccentric cam; and a middle member pivotally coupled with a cam shaft and the connection link so as to rotate about the cam shaft.

2. The apparatus according to claim 1, wherein a low-pressure solenoid valve is provided between the high-pressure pump and the oil pump so as to selectively restrict an inflow of oil into the high-pressure pump.

3. The apparatus according to claim 1, wherein a spring is provided to a cylinder part of the high-pressure pump so as to force the high-pressure pump to be compressed when the low-pressure oil is not introduced into the cylinder part.

4. The apparatus according to claim 1, wherein a first check valve is provided between the high-pressure pump and the oil pump so as to prevent the high-pressure oil generated from the high-pressure pump from flowing reversely towards the oil pump.

5. The apparatus according to claim 1, wherein a second check valve is provided between the high-pressure pump and the high-pressure rail so as to prevent the oil in the high-pressure rail from flowing into the cylinder part.

6. The apparatus according to claim 1, wherein the high-pressure rail includes a pressure control valve provided above the cam shaft in a longitudinal direction of the cam shaft and configured to discharge the oil contained therein out of the high-pressure rail when an internal pressure of the high-pressure rail reaches a predefined pressure level or more in order to maintain a constant pressure of the oil contained therein.

7. The apparatus according to claim 1, wherein a high-pressure solenoid valve is provided between the high-pressure rail and the operating cylinder so as to regulate an amount of the oil flowing into the operating cylinder.

8. The apparatus according to claim 1, wherein a first end of the operating cylinder is connected with the high-pressure rail and the plunger comes into contact with an upper side of a rocker arm such that the rocker arm rotates as the pressure of the oil increases while the oil is introduced into the operating cylinder, so as to regulate an amount of lift of the intake or exhaust valve.

9. The apparatus according to claim 1, wherein the operating cylinder is provided with a drain hole for oil, through which the oil is discharged irrespective of feeding of oil to the operating cylinder.

* * * * *